United States Patent [19]

Eckert

[11] Patent Number: 4,647,291

[45] Date of Patent: Mar. 3, 1987

[54] ANTI-MIST LIQUID DEGRADATION

[75] Inventor: John A. Eckert, Stewartsville, N.J.

[73] Assignee: Exxon Research and Engineering Company, Florham Park, N.J.

[21] Appl. No.: 808,036

[22] Filed: Dec. 12, 1985

[51] Int. Cl.[4] ..... C10L 1/24

[52] U.S. Cl. ..... 44/62; 44/68; 44/70

[58] Field of Search ..... 44/62, 70, 68

[56] References Cited

U.S. PATENT DOCUMENTS

| | | | |
|---|---|---|---|
| 4,002,436 | 1/1977 | Osmond et al. | 44/62 |
| 4,381,414 | 4/1983 | Beach et al. | 44/62 |
| 4,516,982 | 5/1985 | Duvdevani et al. | 44/62 |
| 4,523,929 | 6/1985 | Duvdevani et al. | 44/62 |

*Primary Examiner*—Mrs. Y. Harris-Smith

*Attorney, Agent, or Firm*—Richard E. Nanfeldt

[57] ABSTRACT

The present invention relates to a process for the degradation of a hydrocarbon, preferably jet fuel solutions, having anti-misting properties in which the hydrocarbon solution contains a copolymer of an alpha-olefin and vinyl alkylenecarboxylic acid.

15 Claims, No Drawings

ANTI-MIST LIQUID DEGRADATION

FIELD OF THE INVENTION

The present invention relates to the degradation of hydrocarbon, preferably jet fuel solutions which have antimisting properties in which the hydrocarbon solution contains a copolymer of an alpha-olefin and a vinyl alkylenecarboxylic acid or a complex of styrene vinyl pyridine/sodium EPDM sulfonate or, more generally, any hydrocarbon soluble polymer system with pendent Bronsted acid or base substituents or Lewis acid or base substituents.

BACKGROUND OF THE INVENTION

Polymeric materials are useful as viscosity enhancers when dissolved in the appropriate solvent system. The principal reason for this behavior is due primarily to the large volume which a single macromolecular chain can occupy within the solvent. An increase in the size of the chain produces a concomitant enhancement in the solution viscosity. However, when the polymer chain is placed in a shear field, segmental orientation takes place in the direction of the shearing force. The viscosity of the fluid dramatically drops due to this orientation phenomena. This is a typical behavior of most solutions containing dissolved polymeric materials. However, if the polymer molecule has a high molecular weight with a relatively flexible backbone and the solvent viscosity is sufficiently high, different behavior can be anticipated. It has been shown by several groups that, with increasing shear rates, the viscosity should show a decrease, followed by a minimum value and a small subsequent increase in cases where both solvent viscosity and polymer molecular weight are very high. This latter effect gives rise to a slight dilatant behavior. However, the above-mentioned conditions required for the appearance of a slight shear thickening behavior in these polymeric solution systems are not applicable for many technologically interesting fluids. In most of the common synthetic polymers it is difficult from a synthetic viewpoint to obtain sufficiently high molecular weight and, in addition, most solvents (for example, jet fuels) have rather low viscosities.

Shear thickening behavior can be useful in effecting anti-misting characteristics. Such a solution can behave as a fairly low viscosity fluid at low shear rates. However, the viscosity begins to rise as the shear rate is progressively increased. Accordingly, the solution can more effectively resist breakup into a mist of minute droplets. This is a very desirable attribute in a variety of fluids of technological interest and specifically jet fuels.

In some applications anti-mist action, imparted to a Newtonian liquid by a polymer, must be degraded. For example, anti-mist jet fuel or kerosene (AMK) must be degraded to its original "misting" condition just before combustion in the jet engine. Traditionally this degradation is achieved by subjecting the polymeric solution to very high mechanical shear and breaking the polymeric backbone into low molecular weight polymers which do not impart anti-mist characteristics to the fuel. More recently it has been shown that with certain associating polymers this may be achieved with the addition of low molecular weight polar materials (e.g., alcohols, acids, amines) which disrupt interpolymer associations. In either case, the degradation is difficult to fully realize and the misting characteristics of neat jet are difficult to achieve.

SUMMARY OF THE INVENTION

The present invention relates to a process for the degradation of a hydrocarbon, specifically jet fuel, solution having anti-misting properties in which the hydrocarbon solution contains a copolymer of an alpha-olefin and a vinyl alkylene-carboxylic acid or a polymer complex.

GENERAL DESCRIPTION OF THE INVENTION

The present invention teaches that associating polymers may be extracted into a separate solid or liquid phase provided said phase contains a conjugate component of the polymer associating component.

An example of the degradation process of the instant invention comprises the step of contacting a hydrocarbon solution of a copolymer of an alpha olefin and a alkylenecarboxylic acid with an inorganic base, such as sodium hydroxide, which causes the hydrocarbon solution to lose its anti-misting properties.

Another example of the degradation process of the instant invention also comprises the step of contacting a hydrocarbon solution of a polymeric complex of styrene vinyl pyridine/zinc EPDM sulfonate with an inorganic acid, such as sulfuric aid, which causes the hydrocarbon solution to lose its anti-misting properties.

One of the hydrocarbon solutions of the instant invention which exhibits anti-misting properties is a copolymer of an alpha-olefin and a alkylenecarboxylic acid. The copolymer is characterized as having polymer backbones which are substantially soluble in the organic liquid, and pendant $(CH_2)_8$ COOH alkylenecarboxylic acid side groups.

The copolymer of the instant invention is a copolymer containing an alpha olefin and a alkylenecarboxylic acid having about 4 to about 20 carbons, more preferably about 9 to about 18, and most preferably about 10 to about 16, wherein the resulting alkylenecarboxylic acid side groups are randomly distributed along the alpha-olefin backbone. The alpha-olefin has about 3 to about 27 carbon atoms, more preferably about 6 to about 25, and most preferably about 6 to about 18. The copolymer contains about 0.01 to about 5 mole percent of the alkylenecarboxylic acid side groups, more preferably about 0.05 to about 3, and most preferably about 0.1 to about 2. The number average molecular weight, as measured by GPC, of the alpha-olefin copolymer is about 10,000 to about 20,000,000, more preferably about 50,000 to about 15,000,000, and most preferably about 100,000 to about 10,000,000. The copolymer of the alpha-olefin and vinyl alkylenecarboxylic acid is formed by partially hydrolyzing with concentrated sulfuric acid or other suitable acids having a sufficiently low pH to effect hydrolysis, wherein the hydrolysis occurs in a solvent which is inert itself to hydrolysis, such as an aliphatic or aromatic hydrocarbon, a copolymer of an alpha-olefin and a vinyl alkylene ester according to the reaction scheme:

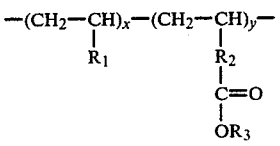

-continued

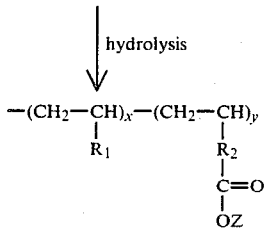

wherein Z is H or a mixture of H plus $R_3$; wherein $R_3$ is an alkyl group having about 1 to about 25 carbon atoms; wherein $R_1$ is hydrogen or an alkyl group having about 1 to about 25 carbon atoms; $R_2$ is an alkylene group having about 3 to about 17 carbon atoms; x is about 99.9 to about 95.0 mole percent, more preferably about 99.95 to about 97.0, and most preferably about 99.90 to about 98.0; y is about 0.01 to about 5.0 mole percent, more preferably 0.05 to about 3.0, and most preferably about 0.1 to about 2.0. Y comprises a mixture of carboxylic acid and ester containing units, since the hydrolysis is only partial, wherein only a portion of the ester groups are hydrolyzed to carboxylic acid groups. The final hydrolyzed product is a mixture of ester species and acid species, wherein the mixture contains about 0.1 to about 90 weight percent of the acid species, more preferably about 2 to about 60, and most preferably about 4 to about 45.

The hydrocarbon solution of the copolymer of the alpha-olefin and the vinyl alkylenecarboxylic acid which exhibits anti-misting properties is formed by forming a solution of the copolymer in an organic liquid, wherein the organic liquid, has a solution parameter of less than 9.5 and is selected from the group consisting of mineral oil, synthetic oil, alkanes, cycloalkanes and aromatics and mixtures thereof. The concentration of the copolymer in the solution is about 0.05 to about 10 grams per 100 ml. of organic liquid, more preferably about 0.1 to about 5.

The process of the degradation of the hydrocarbon solution having anti-misting properties comprises the step of contacting the hydrocarbon solution of the copolymer of the alpha-olefin and the vinyl alkylenecarboxylic acid with an inorganic base for a sufficient period of time to cause degradation of the hydrocarbon solution, thereby creating a hydrocarbon solution without anti-misting properties.

For example, anti-mist jet fuel containing 0.3% poly(octene-1/undecenoic acid) [$Mw2\times10^6$, O/U ratio 99/1] may be degraded completely by shaking the solution with (50%) sodium hydroxide solution. In another test, the anti-mist jet fuel is degraded completely by shaking with solid sodium hydroxide pellets. In another test the anti-mist fuel is degraded by shaking with solid ascarite (NaOH suspended in an inert solid matrix). In yet another test the solution may be degraded by simple filtration through solid sodium hydroxide or solid ascarite, said ascarite being superior to sodium hydroxide pellets, presumably because of Ascarite's superior surface area and ability to absorb more polymer.

Another hydrocarbon solution of the instant invention which exhibits anti-misting properties is polymeric complexes of a sulfonated polymer and an amine containing polymer.

The polymer complex of the instant invention is formed from the interaction of a sulfonated polymer and an amine-containing polymer. The sulfonated polymer is characterized as having polymer backbones which are substantially soluble in the organic liquid and pendant sulfonate group which are substantially insoluble in the organic liquid.

The number of sulfonate groups contained in the sulfonated polymer of the polymer complex is a critical parameter affecting this invention. The number of sulfonate groups present in the polymer can be described in a variety of ways, such as weight percent, mole percent, number per polymer chain, etc. For most polymer systems of interest in this invention it is desirable to employ mole percent. For vinyl homopolymers, such as polystyrene, the sulfonated analog having a sulfonate content of 1.0 mole percent means that one out of every 100 monomer repeat units in the polymer chain is sulfonated. In the case of copolymers, the same definition applied, except for the purposes of this calculation the polymer can be considered to be prepared from a hypothetical monomer having an average molecular eight, which is the average of the two monomer components. Similarly, for terpolymers the same averaging concepts apply; however, three components are involved. For example, ethylene-propylene-ethylidene norbornene (ENB) is a preferred polymer backbone for this invention. A representative terpolymer would have a composition (weight percent) of 50% ethylene, 45% propylene and 5% ENB. This composition has an average repeat unit molecular weight of about 38.9. Thus, sulfonation of this composition, which occurs at the unsaturation of the ENB units, to a level of 1.0 mole per percent, which means that in 38.9 grams (1 mole of average monomer repeat units) of this polymer there would be present 0.01 mole of sulfonic acid groups. An alternate way of expressing this is to state the sulfonic acid groups per 100 grams of polymer. This latter procedure provides a rapid and independent measure of sulfonic acid content in a polymer through simple titration.

Both mole percent sulfonate and milliequivalent of sulfonate will be employed to described the sulfonate polymers employed in this invention.

In general, the sulfonated polymer will comprise from about 4 meq. up to 200 meq. of sulfonate groups, per 100 grams of polymer, more preferably about 10 meq. to about 100 meq. The sulfonated polymers in the instant invention are neutralized with the basic materials selected from the groups consisting of Groups IA, IIA, IVA, VIA, VIIA, VIIIA, IB and IB of the Periodic Table of Elements and lead, tin, aluminum and antimony. A preferred counterion for this invention is zinc, as explained below. Sulfonated polymers which are subject to the process of the instant invention are illimitable and include both plastic and elastomeric polymers. Specific polymers include sulfonated polystyrene, sulfonated t-butyl styrene, sulfonated polyethylene, sulfonated polypropylene, sulfonated styrene/acrylonitrile copolymers, sulfonates, styrene/methyl methacrylate copolymers, sulfonate block copolymers of styrene/ethylene oxide, acrylic acid copolymer with styrene, sulfonated polyisobutylene, sulfonated ethylene-propylene terpolymers, sulfonated polyisoprene, and sulfonated elastomers and their copolymers, such as isoprene-styrene sulfonate copolymer formed by a free radical copolymerization process.

Neutralization of the cited sulfonated polymers with appropriate metal oxides, metal acetates, metal oxides, etc. can be conducted by means well-known in the art. For example, the sulfonation process as with butyl rubber containing a small 0.3 to 1.0 mole percent unsaturation can be conducted in a suitable solvent, such as toluene, with acetyl sulfate as the sulfonating agent. The resulting sulfonic acid derivative can then be neutralized with a number of different neutralization agents, such as sodium phenolate and similar metal salts. The amounts of such neutralization agents employed will normally be stoichiometrically equal or, in some, excess to the amount of free acid in the polymer, plus any unreacted reagent which still is present. It is preferred that the amount of neutralizing agent be equal to the molar amount of sulfonating agent originally employed, plus 10% more to ensure full neutralization. The use of more of such neutralization agent is not critical. Sufficient neutralization agent is necessary to affect at least 50% neutralization of the sulfonic group present in the polymer, preferentially at least 90%, and most preferably essentially complete neutralization of such acid groups should be effected.

The degree of neutralization of said ionomeric groups may vary from 50 to 500 mole percent, preferably 90 to 200%. It is preferred that the degree of neutralization be substantially complete, that is, with no substantial free acid present and without substantial excess of the base, other than that needed to ensure neutralization. Thus, it is clear that the polymers which are utilized in the instant invention comprise substantially neutralized pendant groups and, in fact, an excess of the neutralizing material may be utilized without defeating the objects of the instant invention.

We have surprisingly found that a very important factor in determining the strength of the interaction between the amine-containing polymer and the sulfonate-containing polymer is the nature of the counterion. There are, broadly speaking, three major classes of such counterions. The first class, which are less preferred, are those metals of Group I and Group IIA, which include Li, Na, K, etc., Be, Mg, Ca, etc. We have found that these species do not interact as strongly with amine groups as the more preferred species described below. Those metals are commonly defined as members of the transition elements (see chemical test: *Chemical Principles of Properties* by M. J. Sienko and R. A. Plane, McGraw Hill Book Co., 1974, page 19). These metal cations are best exemplified by zinc and interact strongly with pyridine and similar amines. As a consequence, a zinc neutralized sulfonated polymer interacts much more strongly with a styrene/vinyl pyridine copolymer than does a magnesium or sodium neutralized system. It is for this reason that the transition elements are preferred, with zinc, copper, iron, nickel and cobalt being especially preferred. We also include antimony, titanium, zirconium, chromium, aluminum and lead as suitable cations.

A third species which is preferred is the free acid of the sulfonated polymer, which will also interact with amine-containing polymers. In this latter case it is clear that the interaction is a classic acid-base interaction, while with the transition metals a true coordination complex is created, which is due to the donation of the electron pair of the nitrogen element. This distinction is a very important one and sets these complexes apart from classic acid-base interactions. The surprising observation is that such coordination complexes can form in such extreme dilution insofar as interacting groups are concerned and that they are apparently formed so far removed from their expected stoichiometry (based on small molecule analogs).

The amine-containing polymer of the polymer complex is typically a polymeric backbone where the nitrogen elements are in the chain or pendant to it. Such a polymer may be obtained by direct copolymerization of a monomer containing the basic moiety with other monomers, or by grafting a monomer containing the basic moiety on to a polymerized chain. Monomers can be chosen from vinyl monomers leading to hydrocarbon soluble polymers, such as styrene, t-butyl styrene, acrylonitrile, isoprene, butadiene, acrylates, methacrylates and vinyl acetate. Monomers containing a basic moiety will be those which contain amine or alkyl amine groups or pyridine groups, such as vinyl pyridine.

A preferred basic polymer for this invention is a polymer which is soluble in crude and distilled paraffinic, naphthenic aliphatic and aromatic solvents. A specific, preferred polymer is t-butyl styrene-covinyl pyridine, though lauryl methacrylate convinyl pyridine or other polymers similar to this are common.

The amount of vinyl pyridine in the amine-containing polymer can vary widely, but should range from less than 50 weight percent down to at least 0.5 weight percent. Preferably, the amine content in the basic polymer is expressed in terms of basic nitrogen. In this respect the nitrogen content in amides and similar nonbasic nitrogen functionality is not part of the interacting species. A minimum of three basic groups must be present on the average per polymer molecule and the basic nitrogen content generally will range from 4 meq. per 100 grams of polymer up to 500 meq. per 100 grams. A range of 8 to 200 meq. per 100 grams is preferred.

The sulfonated polymers of the instant invention may vary in number average molecular weight from 1,000 to 10,000,000, preferably 5,000 to 500,000, most preferably from 10,000 to 200,000. These polymers may be prepared by methods known in the art, for example, see U.S. Pat. No. 3,836,511, hereby incorporated by reference.

It is evident that the sulfonated polymers covered within this invention encompass a broad class of hydrocarbon polymer systems. It is important that these hydrocarbon polymer backbones (in the absence of the sulfonate groups) be soluble in the organic liquid. To achieve the desired solubility it is required that the polymer to be employed possess a degree of polarity consistent with that solvent. This solubility relationship can be readily established by anyone skilled in the art simply by appropriate tests (e.g., *Polymer Handbook*, edited by Brandrup and Immergut, Interscience Publishers, 1967, Section IV-341). In the absence of appropriate polymer-solvent compatability knowledge, this can be determined experimentally by observing whether the selected polymer will be soluble in the solvent at a level of 1 gram polymer per 100 ml. solvent. If the polymer is soluble, then this demonstrates that it is an appropriate backbone for modification with sulfonate groups to achieve the objectives of this invention. It is also apparent that polymers which are too polar will not be soluble in the relatively nonpolar organic liquids of this invention. Therefore, only those polymer backbones (i.e., as measured in the absence of ionic groups) having a solubility parameter less than 10.5 are suitable in this invention. This precludes the use of such polymers as polyvinyl alcohol, polyacrylonitrile, etc. Also highly crystalline polymers are to be avoided since they tend not to be soluble in the relatively nonpolar organic liquids employed herein. Therefore, acceptable polymers employed in this invention must possess a level of crystallinity of less than 25%. Thus, these acceptable polymers can be considered substantially noncrystalline.

The preferred sulfonated EPDM terpolymers for use in the instant invention are prepared by sulfonation of an EPDM-containing ethylene norborene unit. Other specific examples of preferred ionomeric polymers which are useful in the instant invention include sulfonated polystyrene, sulfonated poly-t-butyl styrene, sulfonated polyethylene (substantially non-crystalline) and sulfonated polyethylene copolymers, sulfonated polypropylene (substantially noncrystalline) and sulfonated polypropylene copolymers, sulfonated styrenemethyl acrylate copolymers, (styrene)acrylic acid copolymers, sulfonated polyisobutylene, sulfonated ethylene-propylene terpolymers, sulfonated polyisoprene, sulfonated polyvinyl toluene, sulfonated polyvinyl toluene copolymers and isoprene-styrene sulfonate copolymers formed by a free radical copolymerization process.

The sulfonated polymers of the instant invention may be prepared prior to incorporation into the organic solvent, or by neutralization of the acid form in situ. For example, preferably the acid derivative is neutralized immediately after preparation. For example, if the sulfonation of polystyrene is conducted in solution, then the neutralization of that acid derivative can be conducted immediately following the sulfonation procedure. The neutralized polymer may then be isolated by means well known to those skilled in the art, i.e., coagulation, steam stripping or solvent evaporation, because the neutralized polymer has sufficient thermal stability to be dried for employment at a later time in the process of the instant invention. It is well known that the unneutralized sulfonic acid derivatives do not possess good thermal stability and the above operations avoid that problem.

The t-butyl styrene-vinyl pyridine copolymer of the polymer complex is formed by free radical copolymerization using techniques well known in the polymer literature. Such polymers can be prepared by a variety of techniques well known in the polymer literature. Such polymers can be prepared by a variety of techniques with styrene, t-butyl styrene, alkyl acrylates, alkyl methacrylates, butadiene, isoprene vinyl chloride, acrylonitrile, acrylonitrile/butadiene/styrene monomer mixtures and copolymers, or more complex mixtures. An emulsion polymerization process is generally preferred, but other processes are also acceptable.

The vinyl pyridine content of the preferred copolymer of t-butyl styrene and vinyl pyridine is about 0.5 to about 50 mole percent, more preferably about 0.05 to about 20 mole percent, and most preferably about 1 to about 20 mole percent. The number average molecular eight is about 10,000 to about 10,000,000, preferably about 20,000 to about 5,000,000, and most preferably about 30,000 to about 2,000,000.

The hydrocarbon solution of the polymer complex of the sulfonated polymer and the t-butyl styrene-vinyl pyridine copolymer is formed by forming a first solution of the sulfonated polymer in an organic liquid and a second solution of the t-butyl styrene-vinyl pyridene copolymer in the organic liquid, wherein the organic liquid, which has a solubility parameter of less than 9.5, is selected from the group consisting of mineral oil, synthetic oil, crude and distilled alkanes, cycloalkanes, paraffinics, naphthenics and aromatics and mixtures thereof. The concentration of the sulfonated polymer in the first solution is about 0.05 to about 10 grams per 100 ml. of organic liquid, more preferably about 0.1 to about 5. The concentration of the t-butyl styrene-vinyl pyridine copolymer in the second solution is about 0.05 to about 10 grams per 100 ml. of the organic liquid, more preferably about 0.1 to about 5, and most preferably about 0.1 to about 2. The two solutions of the sulfonated polymer and the t-butyl styrene-vinyl pyridine copolymer are mixed together to form the polymer complex, wherein either the sulfonated polymer or t-butyl styrene-vinyl pyridine copolymer can be substantially in excess of the other. The dissolution process is not limited to the above scheme; for example, the two polymers can be simultaneously dissolved in the solvent. The mole ratio between the sulfonate-containing polymer and the amine-containing polymer in solution is about 1:15 to 15:1.

The process of the degradation of the hydrocarbon solution of the amine containing polymer and sulfonated polymer comprises the step of contacting the hydrocarbon solution of the polymer complex of the amine containing polymer and the sulfonated polymer with an solution of strong acid, such as sulfuric acid, for a sufficient period of time to cause degradation of the hydrocarbon solution, thereby creating a hydrocarbon solution without anti-misting properties.

DESCRIPTION OF THE PREFERRED EMBODIMENTS

The followng are preferred embodiments of the instant invention.

EXAMPLE 1

Synthesis of Poly(1-Octene) Having Alkylenecarboxylic Acid Side Chains (a) Copolymerization of 1-Octene and Methyl-10-Undecenoate.

A two liter flask was charged with a mixture of n-heptane (480 ml.), 1-octene (500 ml.), methyl-10-undecenoate (6.4 grams), and diethyl aluminum chloride (72 m mole) and was heated to 60° C. The catalyst containing $TiCl_3$ (2.0 grams) in n-heptane (20 ml.), described in U.S. Pat. No. 4,240,928, was then added. After stirring for 1 hour, the reaction was terminated with a small amount of isopropyl alcohol. The polymer was precipated and washed with isopropyl alcohol and vacuum dried at 60° C. to yield 87.9 grams of colorless material. IR spectrum showed that the copolymer contained 0.8 mole percent of methyl-10-undecenoate unit. The inherent viscosity was 4.3 dl/g in a decalin solution. $\overline{M}$ was $4.6\times10^6$, as measured by GPC.

(b) Hydrolysis of 1-Octene-Methyl-10-Undecenoate Copolymer

A solution of the copolymer (10 grams) in xylene (500 grams) was placed in a 2 liter flask and heated to 40° C. Concentrated sulfuric acid (20 ml.) was then added. After stirring for 1 hour the reaction mixture was cooled down and washed with a mixture of water and isopropyl alcohol three times. A white product was obtained by precipitating from the solution with isopropyl alcohol. Further purification by reprecipitation and drying in a vacuum oven at 50° C. gave 8.0 grams of colorless rubbery polymer. IR spectrum showed that 3 percent of the methyl ester group was converted into corresponding acid form. The partially hydrolyzed copolymer was then dissolved in xylene at a concentration of 1 weight percent. The resulting viscosity of this solution at 25° C. as a function of shear rate was:

| Shear Rate $sec^{-1}$ | Viscosity cP |
|---|---|
| 3 | 63 |
| 10 | 72 |
| 20 | 99 |
| 30 | 171 |
| 60 | 378 |

These data demonstrate a high effectiveness in viscosification, as well as dilatancy or shear thickening. The high viscosification can be demonstrated by comparing the above viscosity data to viscosity of a high molecular weight polyisobutylene (Exxon L-200, with a weight average molecular weight of above 2,000,000) in xylene at the same concentration of 1 weight percent. The later solution was a low shear viscosity of about 24 cP at 3 $sec^{-1}$ and is shear thinning such that the viscosity drops to about 14 cP at 300 $sec^{-1}$. Another comparison could be made to a solution of the non-hydrolyzed copolymer which was used to prepare the above partially hydrolyzed copolymer. The viscosity of this last copolymer in a xylene solution at 1 weight percent concentration was about 6 cP.

EXAMPLE 2

AMK Solution Formulation

Ten grams of hydrolyzed product described in Example 1 above, also known as 1-octene-10-undecenoic acid, was dissolved in 90 grams of toluene or xylene by slow magnetic stirring to yield a 10% concentrate. To this concentrate is then added, drop-by-drop, enough jet fuel to achieve the desired final polymer concentration of, most preferably, between about 0.1 to about 0.5 grams polymer per about 100 grams total solution. Since the conformational state of the starting polymer sometimes depends on the exact nature of the synthetic procedure, it is sometimes necessary to heat treat or "age" the jet fuel solution to achieve the required low shear rate viscosities of less than 3 cP. An example of the heat treatment is to place the jet fuel solution in a sealed glass container and immerse said container in a steam bath for 60–70 hours. Another example of the "aging" process is simply to allow the solution to stand in a sealed container from about 14 days to about 21 days. Low shear rate viscosities of the heat treated or aged solutions are on the order of 2.8 cP for the 0.3 weight percent jet fuel solutions.

EXAMPLE 3

Degradation Process (a) Chemically-Assisted Mechanical Degradation

To about 300 grams of the formulated AMK solution described in Example 2 above was added about 0.3 grams methanol or stearic acid. The resulting solution, although somewhat degraded already by disruption of the inter-polymer associations, is further degraded in a commercial 840 watt, one-quart Waring blender operating at near full power for about 10 minutes.

(b) Liquid-Solid Extractive Degradation

About 1 liter of the formulated AMK solution described in Example 2 above was shaken in a separatory funnel with about 100 grams sodium hydroxide pellets. Alternatively, about 100 grams of Ascarite pellets may be substituted for the sodium hydroxide pellets. It was found that vigorous shaking for about 10 minutes was sufficient to destroy the anti-misting characteristics of the AMK.

An alternative method to the separatory funnel extraction is to slowly filter the AMK solution through either the sodium hydroxide or Ascarite pellets. In this respect the Ascarite pellets appeared to be somewhat more efficient than sodium hydroxide, presumably due to the greater surface area of the Ascarite and the enhanced ability to absorb polymer. The efficiency of the process may be somewhat enhanced by the addition of about 0.1 weight percent methanol, which probably expands the polymer to allow more contact of the carboxylic acid functions with the basic groups on sodium hydroxide and Ascarite. The efficiency and filter life of this process is, of course, dependent on the number of basic surface sites available to accommodate the polymer and the diffusion of the polymer to these surface sites. It is obvious that with proper engineering design and concern for maximum surface exposure of the filter material to the AMK a very efficient, long-lived filter would be expected in actual use.

(c) Liquid-Liquid Degradation

In this technique the AMK is agitated in contact with water or an aqueous solution of sodium hydroxide. As examples, 300 gram portions of the AMK were agitated with about 100 grams of water or 100 grams 25% sodium hydroxide solution in water. The agitation was achieved with a commercial 840 watt, one-quart Waring blender operating at the 120 watt level. At these agitation power levels untreated AMK took over 100 minutes to fully degrade, whereas the water and sodium hydroxide solution-exposed AMK took only about 20 minutes and 10 minutes, respectively, to fully degrade, thus showing the efficacy of the liquid-liquid degradation approach. It is also obvious that with proper engineering design and concern for maximum surface contact of the AMK with the basic liquids a very efficient, long-lived filter would be expected in actual use.

EXAMPLE 4

Preparation of t-Butyl Styrene Vinyl Pyridine Copolymer

A copolymer of t-butylstyrene and vinyl pyridine was prepared via a free radical emulsion copolymerization process. The preparation was conducted as follows:

In a suitable, stirred reaction vessel under a nitrogen blanket the following ingredients were charged:

120 ml. distilled water
50 grams t-butylstyrene
3.2 grams sodium lauryl sulfate
0.1 grams dodecylthiol
0.2 grams potassium persulfate
4.7 grams 4-vinyl pyridine The polymerization was conducted at 50° C. for 24 hours and the resultant emulsion was fluid and uniform. Three ml. of methanol containing 0.1% of hydroquinone was added as an inhibitor and the reaction mixture was precipitated in a large excess of acetone. The precipitate was filtered, then suspended in methanol and blended in a Waring blender to finally disperse the coagulated polymer. The suspension was filtered and dried in a vacuum oven at 60° C. for 24 hours.

The resulting product represented 80% conversion of the reactive monomers and contained 1.68% nitrogen, corresponding to 12.5 mole percent 4-vinyl pyridine incorporation.

EXAMPLE 5

Preparation of Sulfonated EPDM

The preparation of sulfonated EPDM has been well described in the patent and published literature (for example, see U.S. Pat. No. 4,184,988 of ACS Monograph edited by A. Eisenberg, 1980, page 4). A zinc sulfonated EPDM was prepared via those procedures containing 10 meq. of zinc sulfonate, designated Ms-14. The resulting polymer was available as a free-flowing crumb and employed in that form as a blending component in the following Examples.

EXAMPLE 6

AMK Solution Formulation

One gram of the t-Butyl styrene vinyl pyridine copolymer described in Example 4 was directly dissolved in 199 grams of jet fuel using a magnetic stirrer. In a like manner, 1 gram of the sulfonated EPDM described in Example 5 was dissolved in 199 grams jet fuel. The resulting 2 solutions were then mixed together to obtain an AMK solution with 0.5 weight percent total solids or the inter-polymer complex. The resulting complex AMK solution was allowed to age for a period of about 24 to about 48 hours to achieve minimum shear viscosity.

EXAMPLE 7

(a) Chemically-Assisted, Mechanical Degradation

To about 100 grams of the formulated AMK solution complex described in Example 6 above was added about 0.1 grams methanol. The resulting solution, although somewhat degraded already by disruption of the interpolymer complex associations, is further degraded in a commercial 840 watt, one-quart Waring blender operating at near full power for about 10 minutes.

(b) Liquid-Solid Extraction Degradation

About 100 grams of the formulated AMK solution complex described in Example 6 above was shaken vigorously in a separatory funnel with about 10 grams of anhydrous aluminum chloride for about 10 minutes. Most, but not all, of the anti-misting character of the fuel was destroyed, presumably due to the fact that the zinc sulfonated EPDM was retained by the fuel. Although it is believed the fuel is sufficiently degraded at this point for satisfactory combustion, additional treatment with sodium hydroxide or Ascarite pellets would obviously effect further degradation by removing the zinc sulfonated EPDM.

(c) Liquid-Liquid Degradation

In this technique the AMK-formulated in Example 5 is agitated with a strong aqueous acid. As an Example, 100 grams of the AMK was agitated with about 30 grams of 25% sulfuric acid in water in an 840 watt, commercial, one-quart Waring blender operating at the 120 watt level for about 10 minutes. As in case (b) above, further degradation can obviously be achieved by additional treatment with sodium hydroxide solution to remove the zinc sulfonated EPDM.

What is claimed is:

1. A process for the degradation of a solution of a hydrocarbon liquid and a sulfonated polymer and an amine-containing polymer, said solution having anti-misting properties, said hydrocarbon liquid having a solubility parameter of less than 9.5 and being selected from the group consisting of mineral oil, synthetic oil, crude and distilled alkanes, cycloalkanes, paraffins, naphthenic and aromatics and mixtures thereof, said amine-containing polymer being a copolymer formed by copolymerization from a vinyl monomer and a monomer containing a basic moiety selected from the group consisting of amine groups, alkyl amine groups and pyridine groups, wherein the sulfonate content of the sulfonated polymer is about 4 to about 200 meq. of sulfonated groups per 100 grams of the sulfonated polymer and the basic nitrogen content of the amine-containing polymer is about 4 to 500 meq. per 100 grams of the amine-containing polymer, which comprises the step of contacting said solution of said hydrocarbon liquid, said sulfonated polymer and said amine-containing polymer with an inorganic acid.

2. The process of claim 1 wherein said sulfonate groups are neutralized with a basic compound selected from the group consisting of Groups IIA, IVA, VIA, VIIA, VIIIA, IB and IIB of the Periodic Table of Elements and basic lead, aluminum, tin and antimony compounds.

3. The process of claim 2 wherein the neutralized sulfonated polymer contains zinc as the counterions.

4. The process of claim 2 wherein said sulfonated polymer is derived from an EPDM terpolymer.

5. The process of claim 3 wherein the polymer containing basic amine groups is a copolymer of vinyl pyridine with other vinyl monomers.

6. The process of claim 5 wherein the vinyl pyridine containing polymer is a copolymer of t-butyl styrene and vinyl pyridine.

7. The process of claim 5 wherein said sulfonated polymer is in excess of said vinyl pyridine containing polymer.

8. The process of claim 5 wherein said vinyl pyridine-containing polymer is in excess of said sulfonated polymer.

9. The process of claim 1 wherein said sulfonated polymer is selected from the group consisting of sulfonated ethylene, sulfonated propylene, sulfonated ethylenepropylene copolymers and terpolymers, wherein the third monomer is a nonconjugated diene hydrocarbon having from 5 to 15 carbon atoms and sulfonated polystyrene.

10. A process according to claim 1 wherein said hydrocarbon liquid is selected from the group consisting of aliphatic hydrocarbons and aromatic hydrocarbons.

11. A process according to claim 1 wherein said hydrocarbon liquid is selected from the group consisting of benzene, toluene, ethyl benzene, xylene and styrene and mixtures thereof.

12. A process for the degradation of an anti-misting hydrocarbon solution which comprises the step of contacting said hydrocarbon solution containing a copolymer of an alpha-olefin and a vinyl alkylenecarboxylic acid, wherein the concentration of said copolymer in said hydrocarbon is about 0.01 to about 2 grams per 100 ml. of said solution with an inorganic base.

13. The process according to claim 12 further including about 1,000 ppm to about 10 weight percent of a polar cosolvent.

14. The antimisting process according to claim 13 wherein such copolymer has the formula:

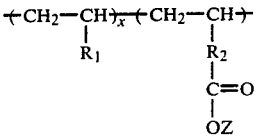

wherein $R_1$ is hydrogen or an alkyl group having about 1 to about 25 carbon atoms; $R_2$ is an alkylene group having about 3 to 17 carbon atoms; z is hydrogen or a mixture of hydrogen and an alkyl group having about 1 to 25 carbon atoms; x is about 95.0 to about 99.99 mole percent; and y is about 0.01 to about 5 mole percent.

15. The anti-misting process according to claim 12 wherein said hydrocarbon is a jet fuel.

* * * * *